US008334660B2

(12) United States Patent
Li et al.

(10) Patent No.: US 8,334,660 B2
(45) Date of Patent: Dec. 18, 2012

(54) LIGHT SOURCE DRIVING CIRCUIT WITH LOW OPERATING OUTPUT VOLTAGE

(75) Inventors: Eric Li, Milpitas, CA (US); Chun Lu, San Jose, CA (US); Yi Zhang, Cupertino, CA (US)

(73) Assignee: SCT Technology, Ltd., Grand Cayman (KY)

( * ) Notice: Subject to any disclaimer, the term of this patent is extended or adjusted under 35 U.S.C. 154(b) by 384 days.

(21) Appl. No.: 12/783,484

(22) Filed: May 19, 2010

(65) Prior Publication Data

US 2011/0285321 A1 Nov. 24, 2011

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 39/02* | (2006.01) |
| *H05B 37/00* | (2006.01) |
| *H05B 39/00* | (2006.01) |
| *H05B 41/00* | (2006.01) |

(52) U.S. Cl. ..... 315/291; 315/209 R; 315/307; 315/312

(58) Field of Classification Search ..... None
See application file for complete search history.

(56) References Cited

U.S. PATENT DOCUMENTS

| | | | | |
|---|---|---|---|---|
| 7,141,936 | B2 * | 11/2006 | McIntyre | 315/209 R |
| 2008/0258636 | A1 * | 10/2008 | Shih et al. | 315/185 R |
| 2009/0195191 | A1 * | 8/2009 | Lin et al. | 315/307 |
| 2010/0289424 | A1 * | 11/2010 | Chang et al. | 315/250 |

* cited by examiner

*Primary Examiner* — Douglas W Owens
*Assistant Examiner* — Dedei K Hammond
(74) *Attorney, Agent, or Firm* — Fenwick & West LLP

(57) ABSTRACT

A driving circuit for regulating current in a light source using a tracking component. The tracking component detects the voltage difference between an input node in the input stage and an output node in the output stage. The input stage is connected to a current source and includes an input transistor. The output stage is connected to the light source and includes an output transistor. The tracking component generates an output that controls the input and output transistors based on the voltage difference between the input node and the output node so that the voltage at the input node tracks the voltage at the output node. By using the tracking component, the LED driver can achieve accurate current control through one output transistor instead of cascaded transistors, resulting in lower output operating voltage and reduced power dissipation of the LED driver. Further, the tracking component is intermittently operated or shared across different channels to reduce energy consumption of the LED driver.

11 Claims, 4 Drawing Sheets

LIGHT SOURCE DRIVING CIRCUIT WITH LOW OPERATING OUTPUT VOLTAGE

BACKGROUND OF THE INVENTION

1. Field of the Invention

The present invention relates generally to a circuit for regulating current in a light-emitting diode (LED).

2. Description of the Related Art

Light-emitting diodes (LEDs) are used in various display devices including LED video billboards. Display devices such as LED video billboards may include a large number of LEDs to produce high resolution images or videos. Brightness of the LEDs in such display devices fluctuate in response to current in the LEDs. Especially in large LED display devices, minor changes in their operating currents may result in flickering visible to human eyes. Therefore, the current in the LED must be regulated by a LED driver circuit to maintain the current constant in the LED.

LED driver circuits may be used to control one or more LEDs. The LED driver functions as a current source or a current sink that regulates current in an LED despite changes in voltage conditions or variations in other operating conditions. Typically, the LED driver circuits consist of digital components that communicate with other digital circuitry in a display device and analog components for controlling the current in the LEDs. The LED driver circuits may be designed to include multiple channels, each channel controlling an LED according to signals received from other digital circuitry in the display device.

FIG. 1 is a circuit diagram of a conventional LED driver implemented by a current mirror. The LED driver of FIG. 1 includes a current source 104, an input stage, a DC voltage source 110, an LED 108 and an output stage. The input stage of the LED driver in FIG. 1 includes MOSFET (metal-oxide-semiconductor field-effect transistor) MI1 and MOSFET MI2. MOSFET MI2 is connected between MOSFET MI1 and ground (GND). The output stage includes MOSFET MO1 and MOSFET MO2. MOSFET MO2 is connected between MOSFET MO1 and ground (GND). The current source 104 and the LED 108 are connected to MOSFET MI1 and MOSFET MO1, respectively. The DC voltage source 110 is connected to the gates of MOSFETs MI1 and MI2 to provide constant gate voltage to MOSFETs MI1 and MO1. The current source 104 provides a reference current Ii to the input stage. In response, the output stage produces output current Io by the well-known operation of the current mirror (comprised of MOSFETs MI1, MI2, MO1 and MO2).

In the LED driver of FIG. 1, MOSFETs are cascaded in the input stage and the output stage to alleviate or remove the short channel effect of MOSFETs MI2 and MO2. FIG. 2 is a graph illustrating the short channel effect of a non-cascaded MOSFET. As illustrated in FIG. 2, a drain-source voltage difference $V_{DS}$ of the MOSFET causes current $I_{DS}$ from the drain to the source of the MOSFET to change because of the short channel effect. That is, as the drain-source voltage difference $V_{DS}$ in MOSFET increases, current $I_{DS}$ in the MOSFET increases even in the saturation region. Since the operating conditions or resistance of the LED may cause drain-source voltage difference $V_{DS}$ to change, the current $I_{DS}$ may vary accordingly. When such MOSFET is used to operate an LED, the changes in the current $I_{DS}$ result in changes in the brightness or flickers in the LED. Hence, many LED drivers adopt a cascaded MOSFET structure as illustrated in FIG. 1 to provide consistent output current Io to the LED 108 despite variations in the drain-source voltage difference $V_{DS}$.

However, cascaded MOSFETs in the LED driver take up a large space in an IC (integrated circuit) chip, especially when attempting to implement a LED driver with a low operating voltage. The increased space occupied by the MOSFETs poses challenges and issues in miniaturizing the IC chip or increasing the number of channels in the IC chip.

SUMMARY OF INVENTION

Embodiments relate to a driving circuit for controlling an output current in a light source. The driving circuit includes an input stage, an output stage and a tracking component between the input stage and the output stage. The input stage is coupled to a current source or to a current sink to generate a reference current. The output stage is coupled to the light source to regulate current in the light source. The tracking component controls transistors in the input stage and the output stage based on input signals received from the input stage and the output stage to provide regulated current in the output stage.

In one embodiment, the tracking component produces an output signal based on the voltage difference between an input node in the input stage and an output node in the output stage. The output signal of the tracking component is fed to the gate of an input transistor in the input stage and the gate of an output transistor in the output stage. The input node is placed between a current source and the input transistor. The output node is placed between the light source and the output transistor. The output voltage of the tracking component increases when the voltage difference between the input node and the output node increases. The output voltage of the tracking component decreases when the voltage difference between the input node and the output node decreases. In this way, the voltage at the input node tracks the voltage at the output node.

In one embodiment, the tracking component comprises an amplifier. The non-inverting input of the amplifier is connected to the input node. The inverting input of the amplifier is connected to the output node.

In one embodiment, the LED driver alternates between a control mode and a hold mode in a cycle to reduce energy consumption. In the control mode, a first switch is turned on to connect an output of the tracking component to the output transistor of the output stage. In the hold mode, the first switch is turned off to disconnect the output of the tracking component and the output transistor of the output stage. In the hold mode, the gate voltage of the output transistor in the output stage is maintained at a level as adjusted in the preceding control mode.

In one embodiment, a second switch is provided between the input transistor in the input stage and the current source or the current sink. The second switch is turned on in the control mode to provide input current to the output transistor in the input stage but turned off in the hold mode to cut off current in the input transistor of the input stage.

In one embodiment, the output stage includes a plurality of channels where each channel is connected to a light source. The input stage is shared by the plurality of channels. The channels are sequentially connected to the tracking component to adjust their input currents.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the present invention can be readily understood by considering the following detailed description in conjunction with the accompanying drawings.

DETAILED DESCRIPTION OF EMBODIMENTS

The Figures (FIG.) and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Embodiments relate to a driver for regulating current in a light source using a tracking component. The tracking component detects the voltage difference between an input node in the input stage and an output node in the output stage. The input stage is connected to a current source or a current sink and includes an input transistor. The output stage is connected to the light source and includes an output transistor. The tracking component generates an output signal that controls the input and output transistors based on the voltage difference between the input node and the output node so that the voltage level at the input node tracks the voltage level at the output node. By using the tracking component, the LED driver can have a lower output operating voltage. Further, the tracking component is intermittently operated or shared across multiple channels to reduce energy consumption of the LED driver.

Figure 1:
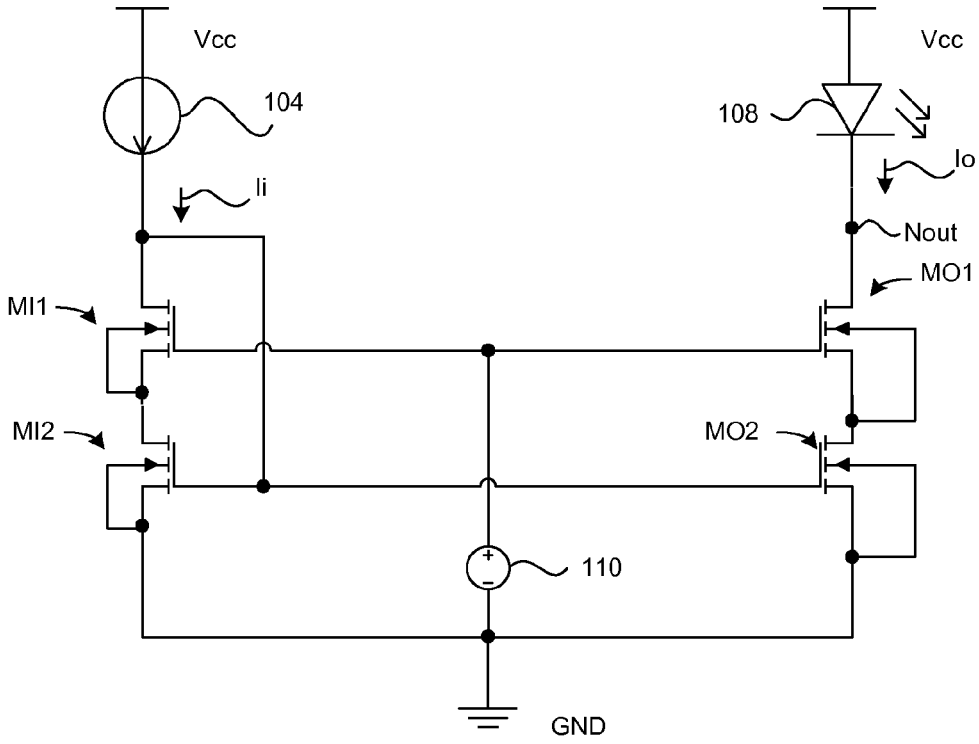
FIG. 1 (PRIOR ART)
FIG. 1 is a block diagram illustrating a conventional LED (light-emitting diode) driver including a current mirror.
Figure 2:
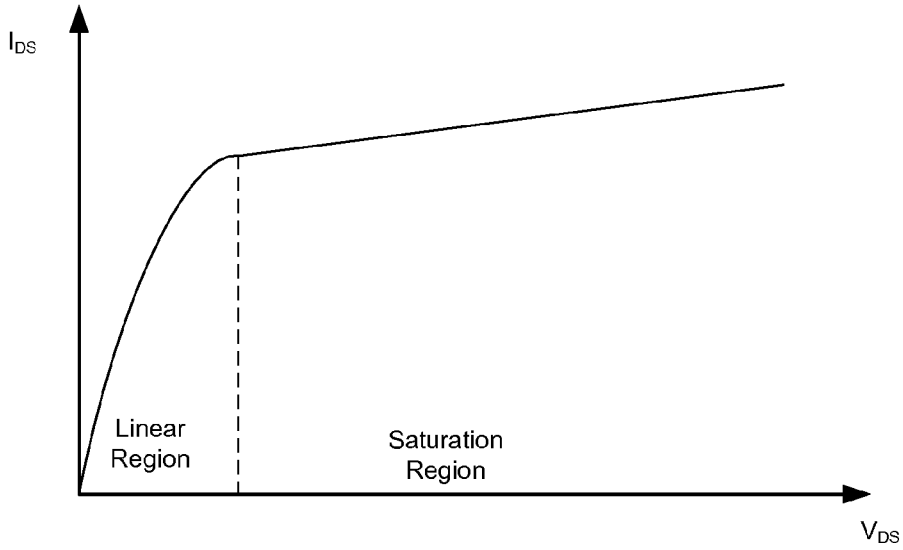
FIG. 2 (PRIOR ART)
FIG. 2 is a graph illustrating relationships between current in a MOSTFET drain-source voltage difference in the MOSFET.
Figure 3:
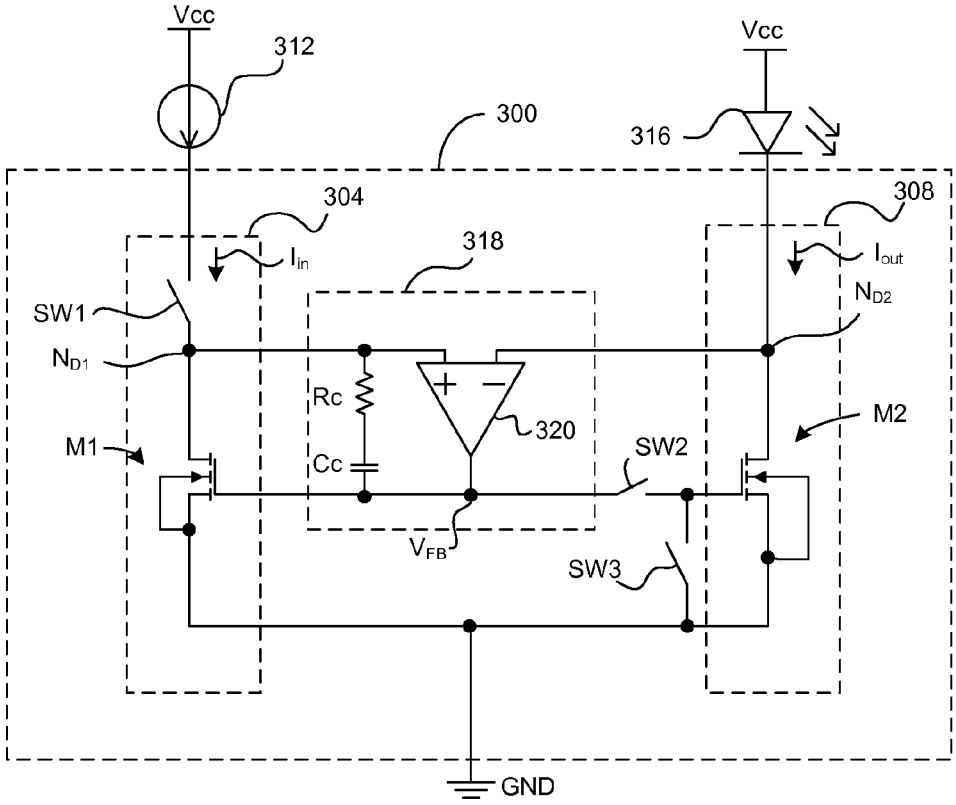
FIG. 3 is a block diagram illustrating the circuitry of an LED driver, according to one embodiment.

FIG. 3 is a block diagram illustrating an LED (light-emitting diode) driver 300, according to one embodiment. The LED driver 300 functions as a current sink that controls output current Iout from LED 316. The LED 316 is connected between a supply voltage source Vcc and the LED driver 300. Although the LED driver 300 is described as being a current sink, modifications may be made to the LED driver 300 so that the LED driver 300 functions as a current source of the LED 316.

The LED driver 300 may include, among other components, a current source 312, an input stage 304, an amplifier module 318, switches SW2 and SW3, and an output stage 308. The amplifier module 318 functions as a tracking component that controls transistors in the input stage 304 and the output stage 308 so that the voltage level at an input node $N_{D1}$ tracks the voltage level at an output node $N_{D2}$. The amplifier module 318 is connected to an input node $N_{D1}$ of the input stage 304 and an output node $N_{D2}$ of the output stage 308. The voltage level at node $N_{D2}$ is generally fixed at a voltage level corresponding to the supply voltage Vcc minus the voltage drop across the LED 316. The voltage drop across the LED 316, however, varies depending on various factors such as type of LEDs and operating conditions of the LED (e.g., temperature). The LED driver 300 regulates output current Iout by having the amplifier 318 form a feedback loop and control MOSFETs (metal-oxide-semiconductor field-effect transistors) in the input stage 304 and the output stage 308.

The input stage 304 may include, among other components, a switch SW1 and MOSFET M1. MOSFET M1 functions as an input transistor. The switch SW1 is connected between the current source 312 and the MOSFET M1. The switch SW1 is operated in conjunction with the switch SW2 to control the gate voltage of MOSFETs M1 and M2 at a certain interval, as described below in detail with reference to FIG. 4. The gate of MOSFET M1 is connected to the output of the amplifier 320 to receive feedback voltage signal $V_{FB}$.

The output stage 308 may include, among other components, MOSFET M2. MOSFET M2 functions as an output transistor. MOSFET M2 is placed between the LED 316 and ground (GND) to regulate output current Iout in the LED 316. The output node $N_{D2}$ is located between the LED 316 and MOSFET M2, and is connected to an inverting input (−) of the amplifier 320. The gate of MOSFET M2 is connected via the switch SW2 to the output of the amplifier 320 to receive the feedback voltage signal $V_{FB}$.

The current source 312 is connected to a supply voltage source Vcc to provide reference input current $I_{in}$ to the input stage 304. Various types of current sources well known in the art may be employed to generate the reference input current $I_{in}$. In one embodiment, the current source 312 is embodied as a current mirror.

The amplifier module 318 controls MOSFET M1 in input stage 304 by feeding the feedback voltage signal $V_{FB}$. The amplifier 320 receives a voltage signal indicating the voltage level at node $N_{D1}$ at its non-inverting input (+), and another voltage signal indicating the voltage level at node $N_{D2}$ at its inverting input (−). In one embodiment, the amplifier 320 generates the feedback voltage signal $V_{FB}$ that increases when the voltage difference between nodes $N_{D1}$ and $N_{D2}$ increases and decreases when the voltage difference between nodes $N_{D1}$ and $N_{D2}$ decreases. In this way, the voltage of input node $N_{D1}$ tracks the fixed voltage of output node $N_{D2}$.

In the input stage 304, when the voltage at node $N_{D1}$ increases, the feedback voltage signal $V_{FB}$ also increases. The increased feedback voltage signal $V_{FB}$ causes MOSFET M1 to decrease the voltage at node $N_{D1}$. Conversely, if the voltage at node $N_{D1}$ decreases, the feedback voltage signal $V_{FB}$ also decreases. The decreased feedback voltage signal $V_{FB}$ causes MOSFET M1 to increase the voltage at node $N_{D1}$. The same feedback voltage signal $V_{FB}$ for tracking the voltage of the input node $N_{D1}$ is also provided to the gate of MOSFET M2 in the output stage 308 to set the output current Iout in MOS- FET M2. In this way, MOSFET M2 can regulate the output current Iout consistently despite any changes in the impedance or voltage drop at the LED 316.

The amplifier module 318 may include, among other components, an amplifier 320, resistor Rc and miller capacitor Cc. The resistor Rc and the miller capacitor Cc are connected in series between the non-inverting input (+) and the output of the amplifier module 318. The resistor Rc is optional and may advantageously remove a closed-loop pole in the feedback loop embodied by the amplifier module 318. The non-inverting input (+) of the amplifier 320 is connected to an input node $N_{D1}$ in the input stage 304. The inverting input (−) of the amplifier 320, on the other hand, is connected to an output node $N_{D2}$ in the output stage 308.

When the switches SW1 and SW2 are turned on, the amplifier 320 maintains the drain-source voltage difference of the MOSFET M1 within a predetermined range. The drain-source voltage $V_{DS}$ of the MOSFET M1 increases when the feedback voltage $V_{FB}$ drops and the drain-source voltage $V_{DS}$ of the MOSFET M1 decreases when the feedback voltage $V_{FB}$ increases. Similarly, the drain-source voltage difference of the MOSFET M2 increases when the feedback voltage $V_{FB}$ drops and the drain-source voltage difference of the MOSFET M2 decreases when the feedback voltage $V_{FB}$ increases.

Because the feedback voltage $V_{FB}$ account for the drain-source voltage differences in MOSFETs M1 and M2, the output current Iout can be regulated without cascading MOSFETs. The LED driver 300 eliminates large-sized MOSFETs from both the input stage 304 and the output stage 308. Hence, the LED driver 300 can have a smaller size compared to the LED drivers using cascaded MOSFETs.

Moreover, the LED driver 300 is also advantageous because its operating voltage can be maintained low compared to LED drivers using cascaded MOSFETs. Compared to LED drivers using multiple cascaded MOSFETs where the output voltage corresponds to aggregated drain-source voltage differences in the multiple MOSFETs, the output voltage at node $N_{D2}$ in the LED driver 300 corresponds to the drain-source voltage difference in a single MOSFET M2. Hence, the LED driver 300 can achieve a lower operating voltage compared to LED drivers using cascaded MOSFETs.

Figure 4:
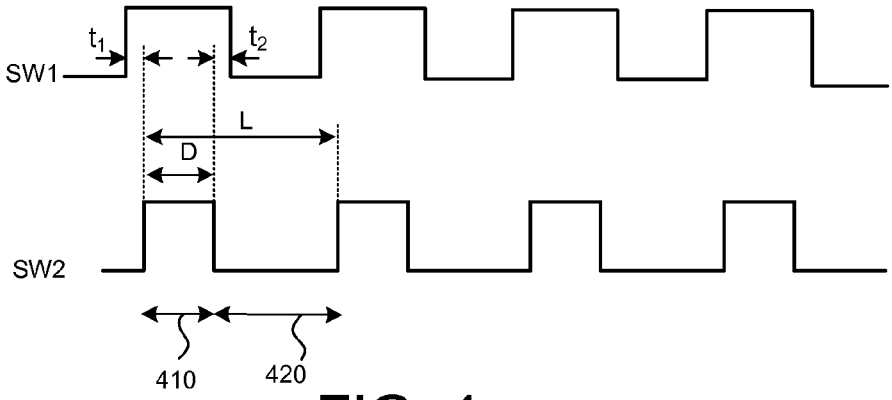
FIG. 4 is a timing diagram of a switching signal for controlling a MOSFET in the output stage of the LED driver, according to one embodiment.

The power consumption of the LED driver 300 can be reduced by periodically operating the input stage 304 and the amplifier 320. FIG. 4 is a timing diagram of a switching signal for controlling switches SW1 and SW2, according to one embodiment. The LED driver 300 alternates between a control mode that lasts for an interval 410 and a hold mode that lasts for the remaining interval 420 in a cycle. In the control mode, the switches SW1 and SW2 are turned on to adjust the gate voltage of the MOSFET M1 and the gate voltage of the MOSFET M2 according to the voltage difference between the input node $N_{D1}$ and output node $N_{D2}$. Specifically, the switch SW1 is turned on earlier than the switch SW2 by time $t_1$ and turned off later than the switch SW2 by time $t_2$.

In the hold mode, the switches SW1 and SW2 are turned off. By disconnecting the current source 312 from the MOSFET M1, no current is consumed by the input stage 304. Also, the gate of the MOSFET M2 is disconnected from the output node of the amplifier 320 by switching off the switch SW2. The voltage level of the gate of MOSFET M2 is maintained at a constant level during interval 420. By maintaining the gate voltage at the constant level, the MOSFET M2 maintains output current $I_{out}$ during the hold mode.

The current Ic consumed by the input stage 304 by periodic activation of the input stage 304 and the amplifier 320 can be expressed in the following equation:

$$Ic=I_{in}\times N\times D/L \quad (1)$$

where N represents the number of channels in the LED driver, D represents the duration of control mode in a cycle, and L represents the duration of a cycle. The input current $I_{in}$ corresponds to Iout/R where R represents the current ratio between the input current $I_{in}$ and the out current $I_{out}$. As shown in equation (1), the current consumption at the input stage 304 can be reduced by increasing L and decreasing D. Although it is advantageous to have a longer L to reduce the energy consumption, the practical length of L is restricted by the current leakage at the gate of the transistor M2. Further, it is advantageous to have a shorter D to reduce the energy consumption. In practice, the length of D is restricted by the settling time of the amplifier 320.

The switch SW3 is operated by the enable signal provided by an external circuitry or other components of the LED driver 300. When the switch SW3 is turned on, the output stage 308 is disabled or turned off because the gate node of MOSFET M2 is connected to ground (GND) and current between the source and the drain of MOSFET M2 is shut off. Conversely, when the switch SW3 is turned off, the output stage 308 is enabled or turned on to regulate the output current Iout and turn on the LED 316.

Although embodiments were described above primarily with reference to a single channel for lighting a single LED, multiple channels may be implemented using multiple series of the same or similar circuit as illustrated in FIG. 3.

In other embodiments, transistors other than MOSFET are used in place of MOSFET M1 and MOSFET M2. For example, bipolar junction transistors may replace MOSFET M1 and MOSFET M2.

Figure 5:
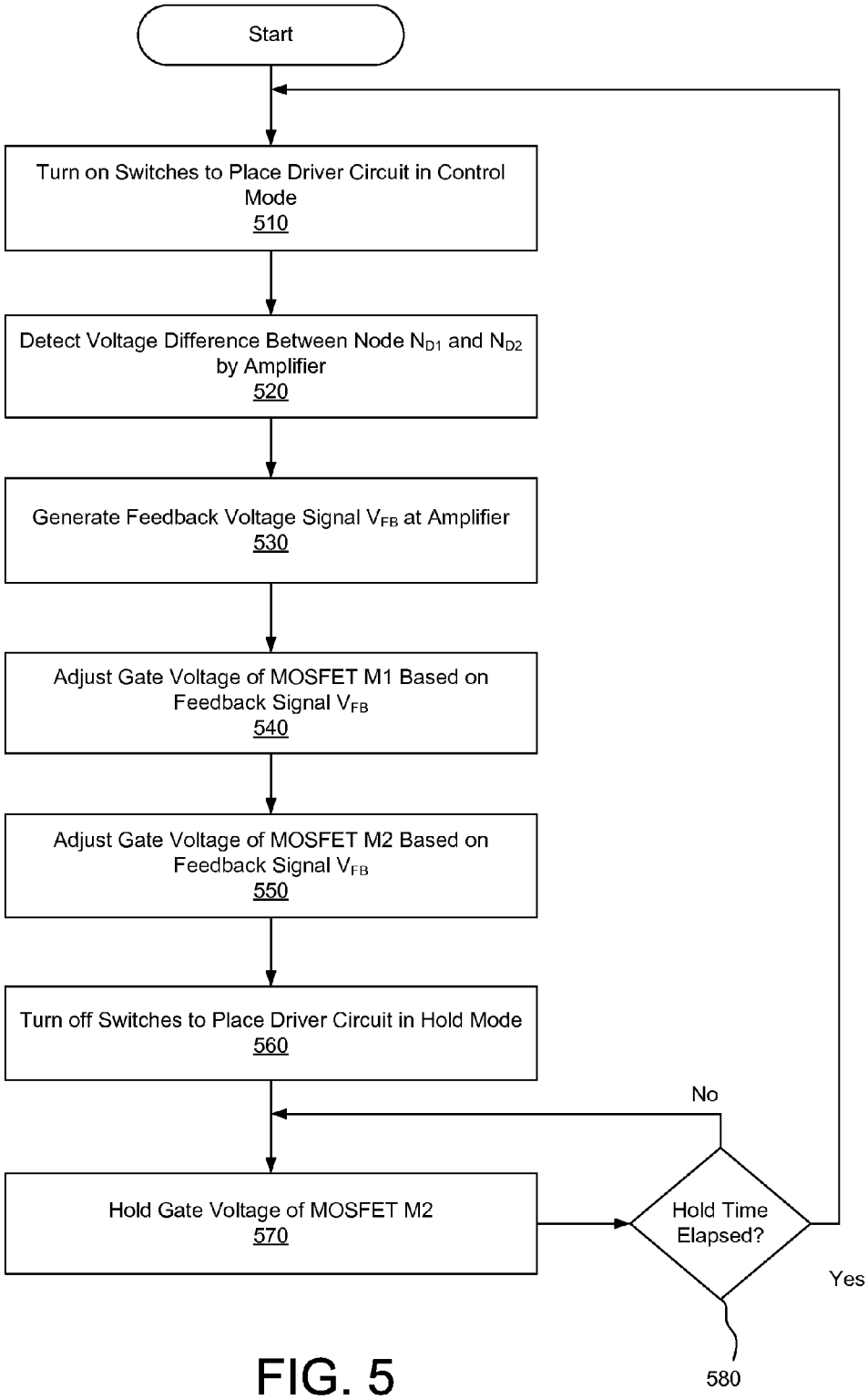
FIG. 5 is a flowchart illustrating the method of operating the LED driver, according to one embodiment.

FIG. 5 is a flowchart illustrating a method of operating the LED driver 300, according to one embodiment. The switches SW1 and SW2 are turned on 510 to place the LED driver 300 in a control mode. In the control mode, MOSFET M2 are controlled to regulate output current Iout. The amplifier 320 detects 520 the voltage difference between the nodes $N_{D1}$ and $N_{D2}$. Based on the voltage difference between the nodes $N_{D1}$ and $N_{D2}$, the amplifier 320 generates 530 feedback voltage signal $V_{FB}$.

The gate voltage of MOSFET M1 in the input stage 304 is then adjusted 540 according to the feedback voltage signal $V_{FB}$ to maintain the drain-source voltage $V_{DS}$ in the MOSFET M1. The gate voltage of MOSFET M2 is also adjusted 550 based on the feedback voltage signal $V_{FB}$ to regulate the output current Iout.

After the time period for control mode expires, the switches SW1 and SW2 are turned off 560 to place the LED driver circuit 300 in a hold mode. In the hold mode, the gate voltage of MOSFET M2 is held 570 at the level determined in the previous control mode.

It is then determined 580 if the hold time period has elapsed. If the hold time period has not elapsed, then the process returns to holding 570 gate voltage of MOSFET M2 at the adjusted level. Conversely, if the hold time period has elapsed, the process returns to turning on 510 the switches SW1 and SW2 to place the LED driver circuit 300 in the control mode and repeats the subsequent steps.

The sequence of steps illustrated in FIG. 5 is merely illustrative and various alternative embodiments may be employed. For example, adjusting 540 of the gate voltage of MOSFET M1 and adjusting 550 of the gate voltage of MOSFET M2 may be performed simultaneously.

Figure 6:
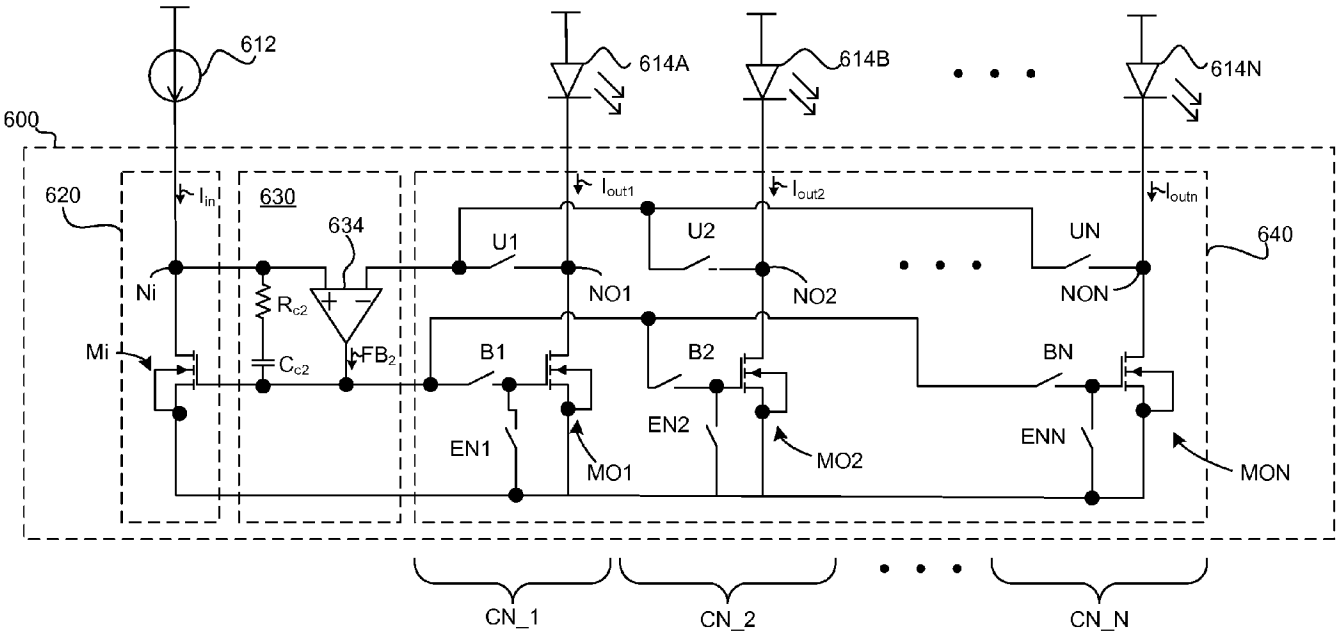
FIG. 6 is a block diagram illustrating the circuitry of a LED driver, according to another embodiment.

FIG. 6 is a block diagram illustrating the circuitry of a LED driver 600, according to another embodiment. The LED driver of FIG. 6 has components that control an output stage 640 that include multiple channels CN_1 through CN_N, each powering one of the LEDs 614A through 614N. That is, instead of providing an input stage and an amplifier module for each channel of the output stage, the LED driver of FIG. 6 shares the input stage 620 and the amplifier module 630 across multiple channels of the output stage 640. The input stage 620 and the error module 630 are connected to each channel sequentially channel-by-channel. In this way, the number of circuit elements for implementing a multiple-channeled LED driver can be reduced and the current consumption associated with controlling multiple LEDs can be decreased.

The LED driver 600 of FIG. 6 may include, among other components, an input stage 620, an amplifier module 630, and an output stage 640. The input stage 620 is similar to the input stage 304 of FIG. 3 except that the input stage 620 lacks the switch SW1. The input stage 620 provides reference current $I_{in}$. However, unlike the input stage 304 of FIG. 3 where the input current $I_{in}$ is wasted for an extensive time 420 of a cycle (see FIG. 4) unless the switch SW1 is turned off, the input stage 620 operates most of the time to control one of the multiple channels CN_1 through CN_N in the output stage 640. Accordingly, the input current $I_{in}$ wasted in the input stage 620 of FIG is negligible compared to the input stage 304 of FIG. 3. The efficiency increased by shutting off the input current $I_{in}$ in the input stage 620 is likely to be minimal, and therefore, the input stage 600 does not include a switch for shutting off the input current $I_{in}$. However, if the LED driver has only a small number of channels or the increase in the efficiency by shutting off the input current $I_{in}$ becomes significant for other reasons, then a switch may be provided between the input node Ni and a current source 612 to shut off the input current $I_{in}$ between the times the switching signals are high.

The amplifier module 630 is essentially the same as the amplifier module 318 of FIG. 3. The amplifier module 630 may include an amplifier 634, resistor $R_{c2}$ and miller capacitor $C_{c2}$. The function and operation of the resistor $R_{c2}$ and the miller capacitor $C_{c2}$ are the same as the resistor Rc and the miller capacitor Cc of FIG. 3, and therefore, description thereof is omitted herein for the sake of brevity. The amplifier module 630 generates and outputs feedback voltage signal $FB_2$ so that voltage at the input node Ni tracks the output voltage of one of the output nodes NO1 through NON.

The output stage 640 includes N channels, each channel regulating output current in an LED despite changes or differences in operating conditions or characteristics of the LED. In one embodiment, the LED driver includes 16 channels in the output stage. Each channel of the output stage 640 may include, a MOSFET and three switches. Taking the example of the first channel CN_1, the first channel CN_1 may include MOSFET MO1 and switches U1, B1 and EN1. Other channels of the output stage 640 also include respective switches and MOSFETs.

When the switching signal SW_1 is turned active, the switches U1 and B1 are closed while switches U2 through UN and B1 through BN in other channels are opened. As a result, the non-inverting input (+) of the amplifier 634 is connected to the output node NO1, and the output of the amplifier 634 is connected to the gate of MOSFET MO1. The amplifier 634 produces feedback signal $FB_2$ that controls the gate voltage level of the MOSFET MO1, as described above in detail with reference to FIG. 3. By controlling the gate voltage level of the MOSFET MO1, the output current $I_{out1}$ in LED 614A can be controlled.

After the switching signal SW_1 turns low and switching signal SW2 turns high, the switches U1 and B1 are opened, and other sets of switches (e.g., U2 and B2) are turned on. Consequently, the gate of the MOSFET MO1 is cut off from the output of the amplifier 634. Hence, the gate of the MOSFET MO1 is held at a constant voltage level until the signal SW_1 again turns high.

Figure 7:
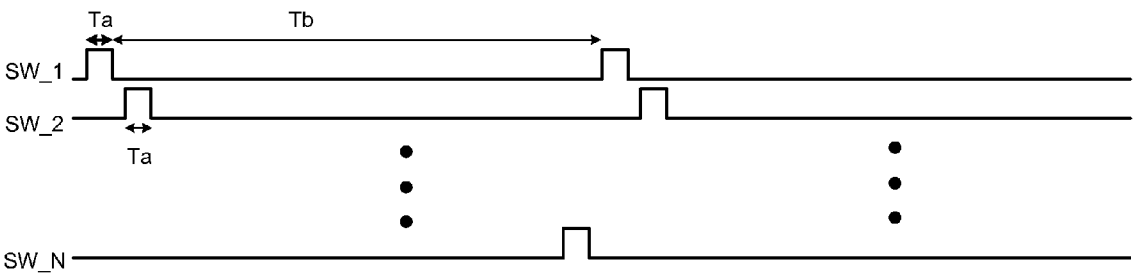
FIG. 7 is a timing diagram illustrating switching signals for controlling multiple output channels of the LED driver in FIG. 6, according to one embodiment.

FIG. 7 is a timing diagram of switching signals SW1 through SWN for controlling different channels of the LED driver in FIG. 6, according to one embodiment. Each of the switching signals SW_1 through SW_N is associated with controlling each of channels CN_1 through CN_N. When a switching signal (e.g., SW_1) is active, other switching signals (e.g., SW_2 through SW_N) are inactive, as illustrated in FIG. 7. One channel is controlled at a time by the amplifier module 630 while other channels are placed in a hold mode. In this way, the input stage 620 and the amplifier module 630 controls output currents $I_{out1}$ through $I_{outn}$ channel-by-channel.

In the example of FIG. 7, each of the switching signals SW_1 through SW_N turns active for a predetermined time Ta and then remains inactive for the remaining time Tb in a cycle. During the predetermined time Ta, the output current (e.g., $I_{out1}$) in the corresponding channel is adjusted while the output currents (e.g., $I_{out2}$ through $I_{outn}$) are held at a level previously adjusted. After the predetermined time Ta passes, the output current (e.g., Iout1) is held at a constant level for the predetermined time Tb until the corresponding channel is again connected to the amplifier module 630 for adjustment.

Each channel of the LED driver of FIG. 6 also includes an enable switch EN1 through ENN. The operation and the function of the enable switch EN1 through ENN are the same as the switch SW3 of FIG. 3, and the detailed description thereof is omitted herein for the sake of brevity.

The sequence of switching signals SW_1 through SW_N of FIG. 7 is merely illustrative. As long as two or more switching signals SW_1 through SW_N are not turned on at the same time, the switching signals SW_1 through SW_N may be switched in various other sequences. Further, the switching signals SW_1 through SW_N may be switched in a random manner.

In one embodiment, the duration of the control period Ta and hold period Tb are different for each channel of the output stage 614. That is, a longer or shorter controller period Ta may be set for different channels CN_1 through CN_N of the output stage 614.

Embodiments of the present invention may be employed to drive light sources other than LED. For example, embodiments may be employed to drive a laser device.

Although the present invention has been described above with respect to several embodiments, various modifications can be made within the scope of the present invention. Accordingly, the disclosure of the present invention is intended to be illustrative, but not limiting, of the scope of the invention, which is set forth in the following claims.

What is claimed is:

1. A driving circuit for a light source, comprising:

an input stage comprising a first transistor connected to a current source or a current sink and a first node between the first transistor and the current source or the current sink;

an output stage comprising at least one second transistor for coupling to the light source and at least one second node between the second transistor and the light source; and a tracking component comprising a first input coupled to a first node in the input stage and a second input coupled to a second node in the output stage, the tracking component generating an output signal to control the first transistor and the at least one second transistor so that a voltage level of the first node tracks a voltage level of the second node, wherein the tracking component comprises an amplifier generating an output signal that increases as a voltage difference between the first node and the at least one second node increases, the output signal decreasing as a voltage difference between the first node and the at least one second node decreases;

a first switch between the amplifier and a gate of the second transistor, the first switch turned on to receive the output signal from the amplifier in a control mode and turned off in a hold mode; and a second switch between the first transistor and the current sink or the current source, the second switch turned on in the control mode and turned off in the hold mode.

2. The driving circuit of claim 1, wherein an output of the amplifier is coupled to the gate of the first transistor and the gate of the second transistor.

3. The driving circuit of claim 1, further comprising a third switch between the gate of the second transistor and ground, the third switch turned on to disable the light source coupled to the output stage.

4. A driving circuit for a plurality of light sources, comprising:

an input stage comprising a first transistor connected to a current source or a current sink and a first node between the first transistor and the current source or the current sink;

an output stage comprising a plurality of channels, each channel comprising a second transistor for coupling to a light source and a second node between the second transistor and the light source, each channel connected to an amplifier in a sequential manner to control input current in the light source coupled to the channel; and a tracking component comprising a first input coupled to a first node in the input stage and a second input coupled to a second node in the output stage, the tracking component generating an output signal to control the first transistor and the at least one second transistor so that a voltage level of the first node tracks a voltage level of the second node, wherein the tracking component comprises the amplifier generating an output signal that increases as a voltage difference between the first node and the at least one second node increases, the output signal decreasing as a voltage difference between the first node and the at least one second node decreases.

5. The driving circuit of claim 4, wherein each channel comprises a first switch and a second switch, the first switch placed between the amplifier and a gate of the second transistor of the channel, the first switch turned on to receive the output signal from the amplifier in a control mode and turned off in a hold mode, the second switch placed between the first transistor and the current sink or the current source, the second switch turned on in the control mode and turned off in the hold mode.

6. The driving circuit of claim 1, wherein the light source comprises a light emitting diode.

7. A method of controlling an output current of a light source, comprising:

receiving a first voltage signal from a first node between a first transistor and a current source or a current sink in an input stage;

receiving a second voltage signal from a second node between a second transistor and the light source in an output stage; and adjusting first gate voltage of the first transistor and second gate voltage of the second transistor so that a voltage level of the first node tracks a voltage level of the second node;

generating an output signal at an amplifier that increases as a voltage difference between the first node and the second node increases, and decreases as a voltage difference between the first node and the second node decreases, the output signal provided to a first gate of the first transistor and a second gate of the second transistor;

turning on a first switch between the amplifier and a gate of the second transistor to receive the output signal from the amplifier in a control mode;

turning off the first switch in a hold mode to disconnect an output of the amplifier from the gate of the second transistor;

turning on a second switch between the first transistor and the current sink or the current source in the control mode; and turning off the second switch in the hold mode.

8. The method of claim 7, further comprising:

turning on a third switch between the second gate of the second transistor and ground to disable the light source coupled to the output stage.

9. A method of controlling an output current of a plurality of light sources, comprising:

receiving a first voltage signal from a first node between a first transistor and a current source or a current sink in an input stage;

receiving a second voltage signal from a second node between a second transistor and the light source in an output stage;

adjusting first gate voltage of the first transistor and second gate voltage of the second transistor so that a voltage level of the first node tracks a voltage level of the second node;

coupling a first channel in the output stage to the amplifier responsive to receiving a first switching signal, the first channel coupled to a first light source; and coupling a second channel in the output stage to the amplifier responsive to receiving a second switching signal, the second channel coupled to a second light source, the first switching signal and the second switching signal not overlapping in time.

10. The method of claim 9, wherein the first switching signal and the second switching are received in a sequential manner.

11. The method of claim 7, wherein the light source comprises a light emitting diode.

* * * * *

UNITED STATES PATENT AND TRADEMARK OFFICE

CERTIFICATE OF CORRECTION

PATENT NO. : 8,334,660 B2
APPLICATION NO. : 12/783484
DATED : December 18, 2012
INVENTOR(S) : Eric Li et al.

It is certified that error appears in the above-identified patent and that said Letters Patent is hereby corrected as shown below:

In the Claims:

In claim 7, column 10, line 8, after "output stage;" please delete "and".

Signed and Sealed this
Twenty-third Day of July, 2013

Teresa Stanek Rea
*Acting Director of the United States Patent and Trademark Office*